US007163367B2

(12) United States Patent
Handley

(10) Patent No.: US 7,163,367 B2
(45) Date of Patent: Jan. 16, 2007

(54) MULTI-POSITION HEIGHT ADJUSTMENT SYSTEM FOR A PIPE HANDLING APPARATUS

(75) Inventor: Richard A. Handley, Alberta (CA)

(73) Assignee: Forum Canada ULC, Calgary (CA)

( * ) Notice: Subject to any disclaimer, the term of this patent is extended or adjusted under 35 U.S.C. 154(b) by 464 days.

(21) Appl. No.: 10/683,379

(22) Filed: Oct. 14, 2003

(65) Prior Publication Data

US 2005/0079044 A1 Apr. 14, 2005

(51) Int. Cl.
*B66F 11/00* (2006.01)

(52) U.S. Cl. ..... 414/745.8; 414/745.9; 414/22.54; 414/22.62; 405/166

(58) Field of Classification Search ..... 414/22.51, 414/22.52, 22.54, 22.55, 22.65, 22.67, 22.68, 414/22.69, 561, 567, 569, 688, 689, 695, 414/697, 701, 718, 743, 745.1, 745.4, 745.7, 414/745.8, 745.9, 22.62; 212/258, 260, 292, 212/300; 198/861.3, 861.5; 280/79.3, 79.6; 172/466, 481, 683, 753, 776; 405/166
See application file for complete search history.

(56) References Cited

U.S. PATENT DOCUMENTS 3,860,122 A * 1/1975 Cernosek ..... 414/732
4,235,566 A * 11/1980 Beeman et al. ..... 414/22.61
4,379,676 A * 4/1983 Frias ..... 414/745.8
4,386,883 A * 6/1983 Hogan et al. ..... 414/22.61
4,426,182 A * 1/1984 Frias et al. ..... 414/22.61
4,494,899 A * 1/1985 Hoang et al. ..... 414/22.61
4,684,314 A * 8/1987 Luth ..... 414/746.1
5,658,087 A * 8/1997 Butkovich et al. ..... 403/359.5
6,079,925 A * 6/2000 Morgan et al. ..... 414/22.57
6,899,510 B1 * 5/2005 Morelli et al. ..... 414/745.8

* cited by examiner

*Primary Examiner*—Eileen D. Lillis
*Assistant Examiner*—Michael Lowe
(74) *Attorney, Agent, or Firm*—William J. Bundren; Johnny J. Haugen

(57) ABSTRACT

A system for adjusting the height of a boom on a pipe handling apparatus. A cavity is formed in the base between proximal and distal ends. The boom is nestable in said cavity and has a distal end guided along the base. A pivoting member is pivotally coupled to said boom for raising a proximal end for positioned adjacent a work floor for handling of pipe therebetween. A plurality of ports are arranged along the boom at a pre-determined spacing. A plurality of ports are is similarly arranged along the same predetermined spacing along the pivoting member. The spacing of the boom and arm ports is such that a hinge pin can engage any one of corresponding pairs of boom and arm port when the boom is lowered to nestle inside the cavity as each boom port corresponds with an arm port.

19 Claims, 15 Drawing Sheets

PRIOR-ART

MULTI-POSITION HEIGHT ADJUSTMENT SYSTEM FOR A PIPE HANDLING APPARATUS

FIELD OF THE INVENTION

The present invention relates generally to pipe handling systems and in particular to a system for providing drill pipe to, and receiving drill pipe from, work floors of a derrick or rig which may be positioned at various heights from the ground.

BACKGROUND OF THE INVENTION

Drill strings of pipe for oil and gas wells are assembled or disassembled vertically on a derrick one joint at a time, and are stored horizontally on pipe racks situated on the ground adjacent the rig. The work floor of the rig is typically elevated substantially above the pipe rack such that transferring sections of pipe to and from the work floor and the racks is necessary and requires careful handling of the heavy pipe to protect the workers and the pipe.

As shown in FIG. 1, a common prior art solution in the context of a transportable trailer is a pipe handling apparatus implementing a base supporting a pivoting boom having a pipe receiving trough along its upper surface. The boom has an upper end which can be placed adjacent to and raised to the height H of a derrick or rig floor (not shown), and a lower end which is movable along the base. Typically the lower end is guided in a cavity in the base which also serves to receive the boom therein when lowered. An arm pivots between the base and the boom for raising the boom from the base to the floor height. At the end of a pipe lowering operation, as well as during transport or storage, the boom is retracted to nest into the cavity.

Although effective to raise the upper end to a predetermined height H, this type of prior art pipe handling apparatus does not readily permit adaptation to raise the upper end to a range of different rig floor heights. Through some extreme manipulation, this prior art apparatus can accomplish a lower than usual design elevation of the booms upper end by re-positioning the base, spaced further back from the rig floor than normal, and then over-extending the pivoting arm towards the floor to an obtuse angle relative to the base. However, in such a case the end of the pivoting arm attached to the boom travels well over the point at which it is pivoted from the base. This in turn increases hydraulic actuator travel, requiring a more expensive type of double-acting hydraulic ram, also capable of pulling a load upon it's return and under a more onerous mechanical disadvantage. The increase in hydraulic travel also requires more time and may not allow the apparatus to keep pace with the pipe handling crew thereby resulting in decreased productivity. The over-extension of the arm also raises additional wear-and-tear, maintenance, safety and structural concerns.

Limitation to a predetermined height H, inherent in the prior art apparatus, is not typically a disadvantage for pipe handling apparatus used by one particular oil or gas drilling company; since a company tends to have all their rig floors at a set height. However in many cases, such as with rental oil field equipment, pipe handling apparatus can services a plurality of different clients having derrick or rig floors at different heights when compared to each other.

There is a demonstrated needed for a pipe handling system wherein the boom can be raised to meet with a range of derrick or rig floor heights without the disadvantages of the prior art.

SUMMARY OF THE INVENTION

In a preferred aspect of the invention a pipe handling apparatus has a base fit with a boom capable of positioning a proximal end at a plurality of elevations adjacent a rig floor. The proximal end of the boom is raised and lowered using a pivoting arm connected between the base and the boom. The distal end of the boom is spaced away from the rig flow and moves slidably along the base. The boom is hinged at the pivoting arm at one or tow or more hinge points preferably comprising a hinge pin and two or more boom ports corresponding with two or arm ports for forming corresponding sets of boom and arm ports. The hinge pin can be engaged with one of the two of more sets of boom and arm ports. Hence a multi-position height adjustment of the boom can be achieved without overextending the pivoting arm. Further, and more preferably, the boom ports are arranged at a predetermined spacing so that each boom port, when lowered to the base, aligns with each corresponding arm ports arranged at the same predetermined spacing such that the hinge pin can be alternatively engaged with any with one of the two of more aligned sets of boom and arm ports. Geometrically, this results in consistent positioning of the distal end of the boom when lowered.

In one broad aspect of the invention, the pipe handling apparatus comprises a longitudinally extending base having a proximal end and a distal end, a longitudinally extending boom having a proximal end, a distal end and a trough extending along the boom and adapted for receiving at least one section of pipe therein, the distal end of the boom being movably guided along the base; a pivoting member pivotally connected between the base and a hinge positioned along said boom, the pivoting member being actuable for raising the proximal end of said boom to a raised position proximate said floor for the purpose of presenting at least one section of pipe to said floor and lowering the proximal end of said boom to a lowered position substantially parallel to the base; and preferably two or more pairs of corresponding ports in the boom and the pivoting member at predetermined spacing for achieving two or more predetermined heights of the proximal end of the boom means when in the raised position. Preferably, the two or more pairs of sockets comprise two or more ports arranged in a pre-determined spacing along the boom; and two or more ports arranged at the pre-determined spacing along the pivoting member, wherein when the boom is in a lowered position, each port in the boom corresponds with a port in the pivoting member to form a set of hinge ports so that the hinge pin can be engaged any one of the sets of hinge ports.

In another embodiment of the above apparatus, the multi-position height adjusting means comprises: a plurality of pin holding means arranged along the boom; an equal number of pin engagement means arranged along the pivoting member; and a hinge pin suitable for removable placement inside the holding means and for removable engagement with the engagement means, wherein when the boom is nestled inside the cavity the pin holding means are spaced from each other so as to correspond with the spacing of the pin engagement means.

In another aspect of the invention, there is provided a system for adjusting the height of a longitudinally extending boom on a pipe handling apparatus, said pipe handling apparatus having a longitudinally extending base having a proximal end and a distal end, a longitudinal cavity between said proximal and distal ends, said boom adapted for nestable positioning in said cavity, a pivoting member coupled to said boom for raising a proximal end of said boom out of said cavity, the system comprising: a plurality of pin holding means arranged along said boom; an equal number of pin engagement means arranged along the pivoting member; and a hinge pin suitable for removable placement inside the holding means and for removable engagement with the engagement means, wherein when the boom is nestled inside the cavity the pin holding means are linearly spaced from each other so as to correspond with the linear spacing of the pin engagement means.

DETAILED DESCRIPTION OF THE PREFERRED EMBODIMENTS

Figure 1:
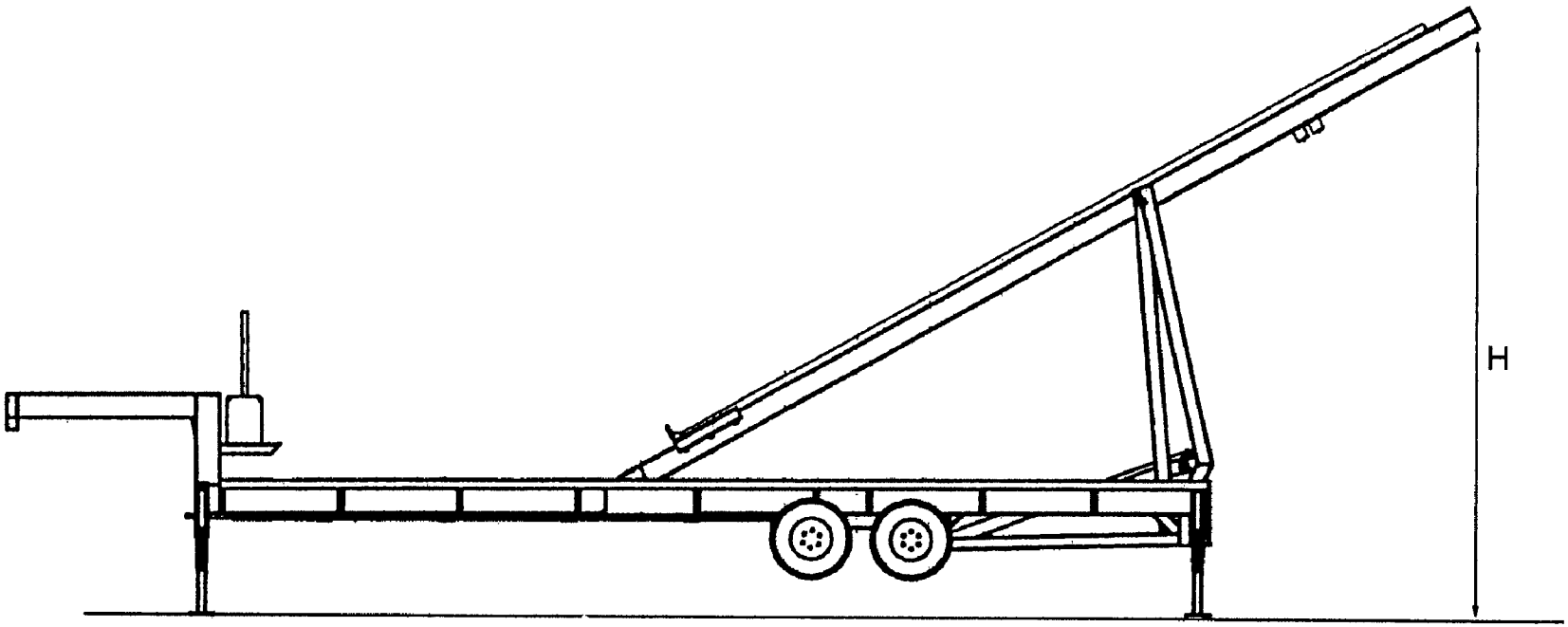
FIG. 1 is a side view of a prior art pipe handling apparatus.
Figure 2:
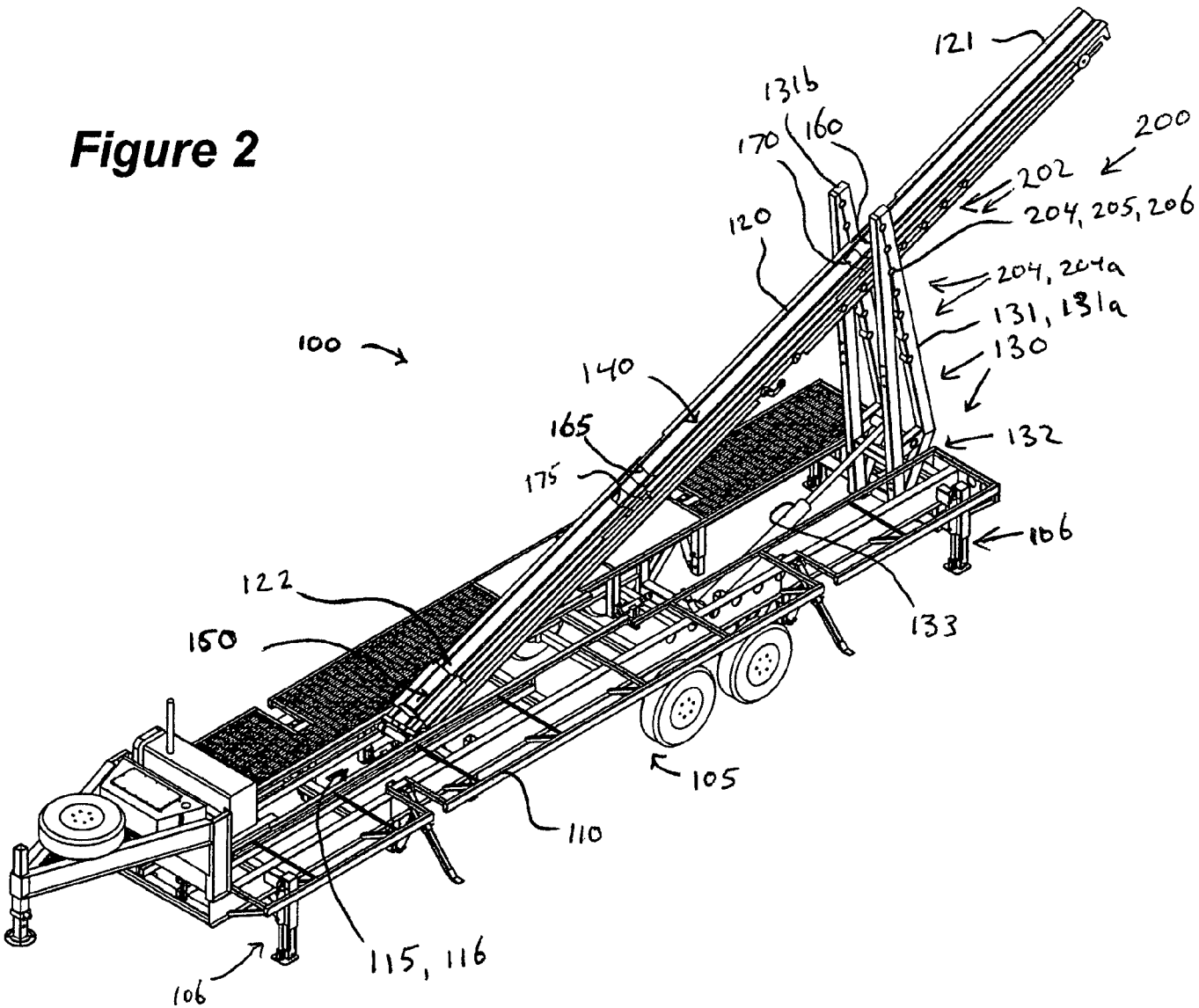
FIG. 2 is a perspective view of one embodiment of the invention wherein a boom's proximal end is operable to be elevated to a plurality of predetermined heights, the boom illustrated being at an intermediate height within one particular embodiment having seven predetermined heights.

Referring to FIG. 2 and generally of FIGS. 2–10*c*, an embodiment of a pipe handling apparatus 100 is shown comprising a multi-position height adjustment system 200. The pipe handling apparatus 100 comprises a longitudinal base 110 mounted on an undercarriage assembly 105. Boom 120 is shown with a proximal end 121 in a raised position and positioned towards a derrick work floor (not shown) and a distal end 122 adjacent the base 105. Herein, the terms proximal and distal are used in relation to the a rig floor, the extreme end of the boom adjacent the floor being referred to as the proximal end 121.

Actuating means 130 are operable to raise the boom 120 and lower the boom substantially parallel to the base 110. The boom is preferably nestled in a cavity 115. As the boom 120 is raised out of the cavity, the proximal end 121 moves towards the derrick work floor with the distal end 122 moving along longitudinal cavity 115. The movement of distal end 122 is guided by track means 116.

Boom 120 is adapted for raising out of and lowering into nestable positioning into cavity 115. The longitudinal extending base 110 typically comprises a framework, having a catwalk around the longitudinal cavity 115 to permit access to the boom 120 and typically includes conventional suitable power supply and controls (not shown).

Figure 4A:
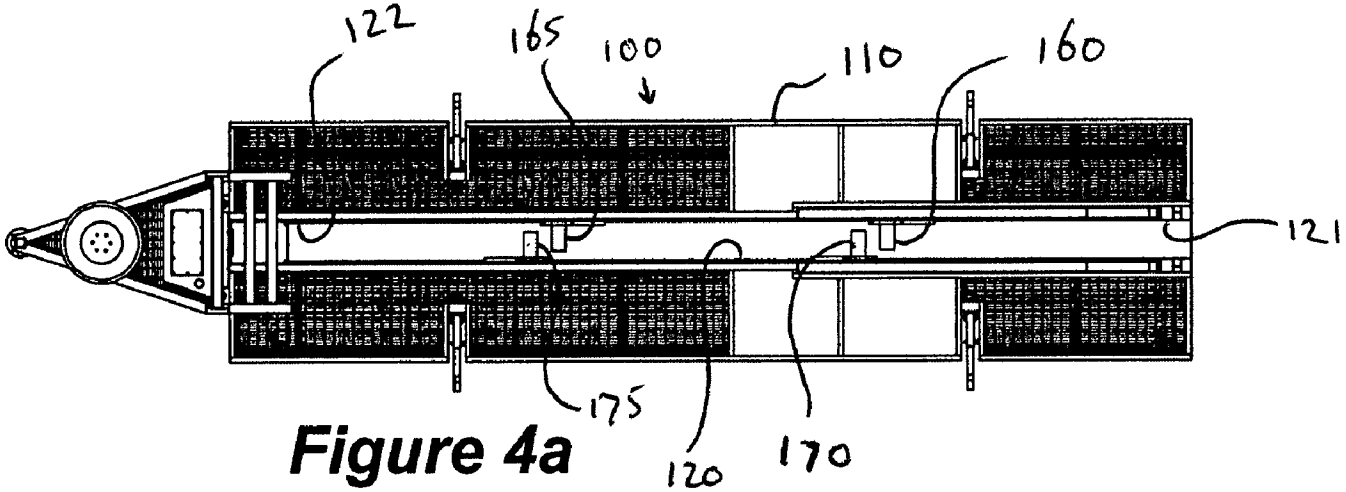
FIGS. 4*a*–4*c* are top, side and rear views respectively, according to FIG. 2, illustrating the boom being completely retracted into a cavity in a base.
Figure 4B:
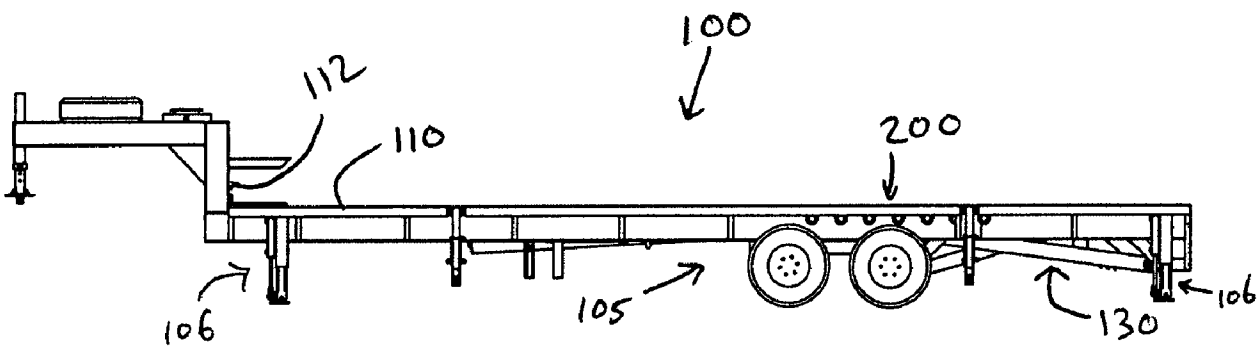
Figure 4C:
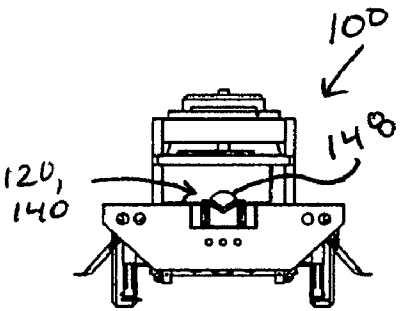
Figure 5A:
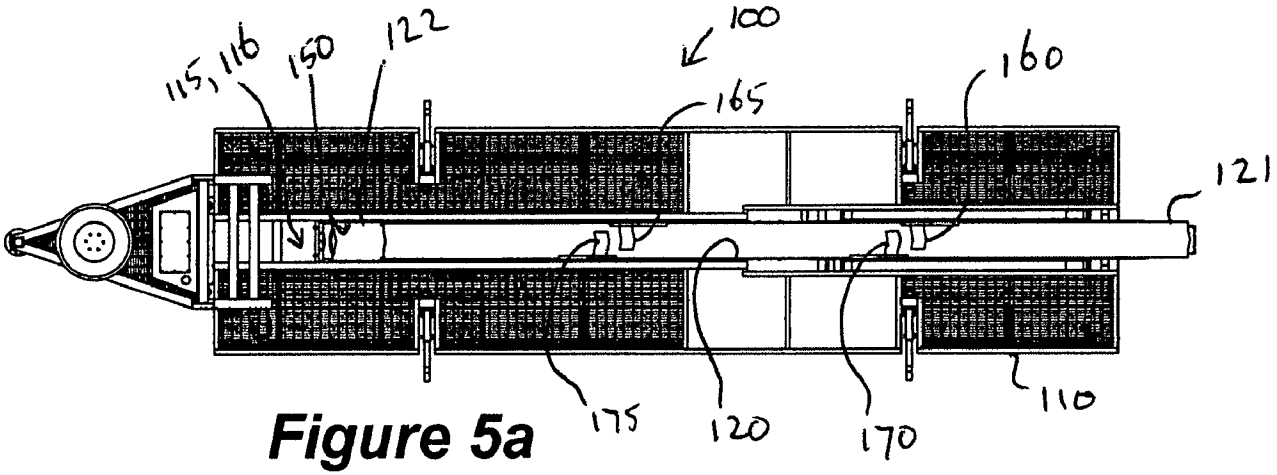
FIGS. 5*a*–5*c* are top, side and rear views according to FIG. 2 illustrating the boom's proximal end partially raised to the highest of the predetermined heights, the distal end of the boom being adjacent a distal end of the base.
Figure 5B:
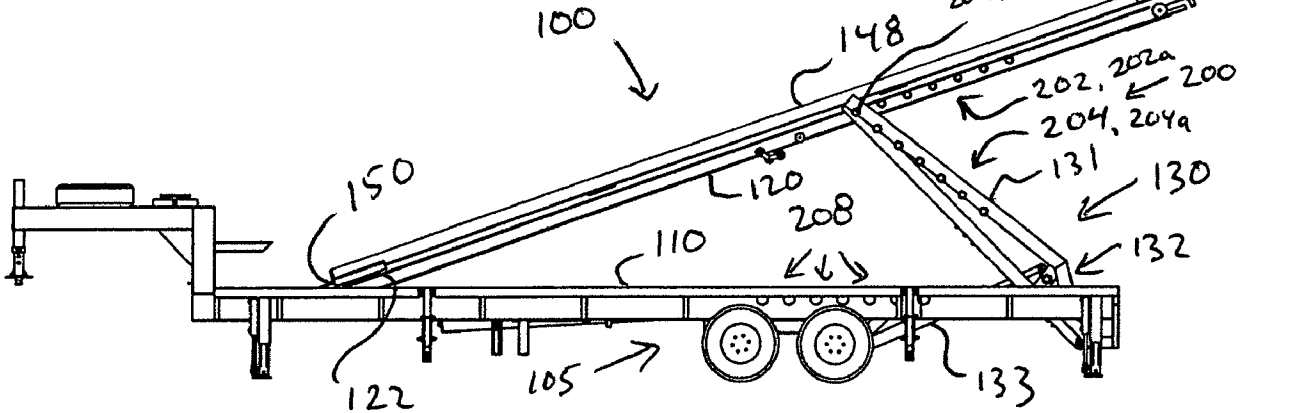
Figure 5C:
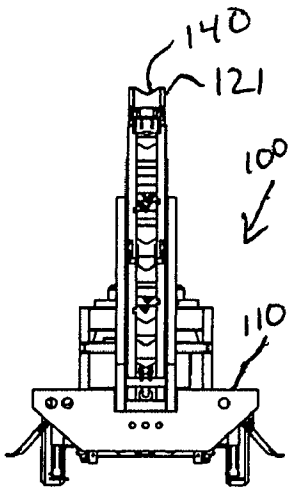
Figure 6A:
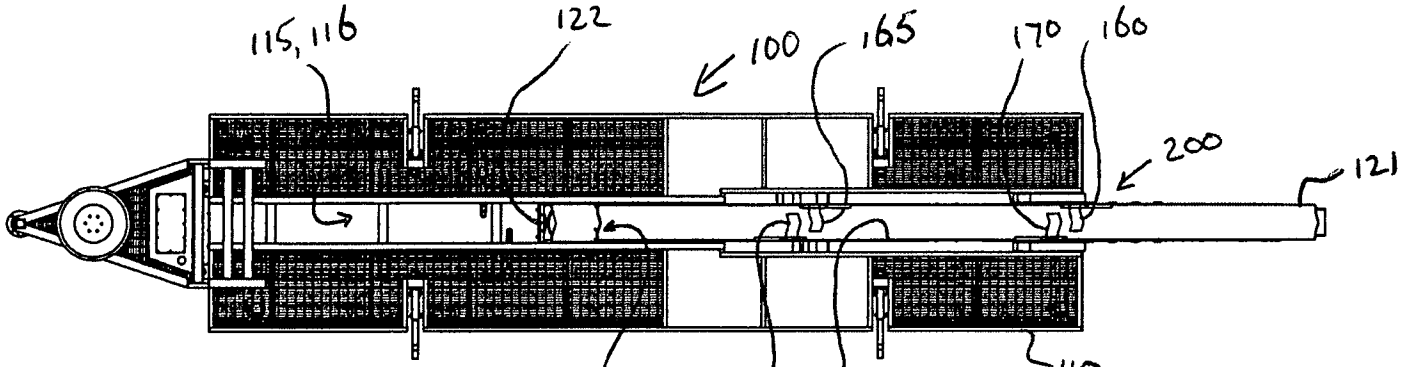
FIGS. 6*a*–6*c* are top, side and rear views according to FIGS. 5*a*–5*c*, illustrating the boom's proximal end fully raised to the highest of the predetermined heights; the distal end of the boom having slid within the cavity toward a proximal end of the base.
Figure 6B:
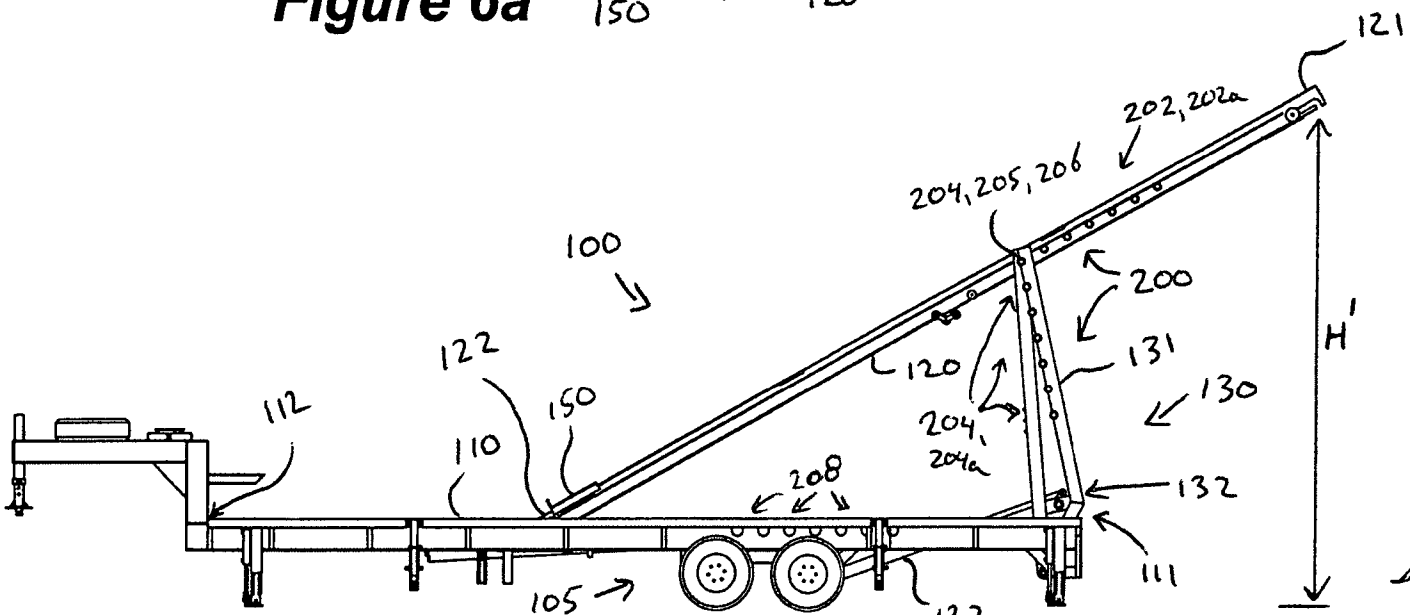
Figure 6C:
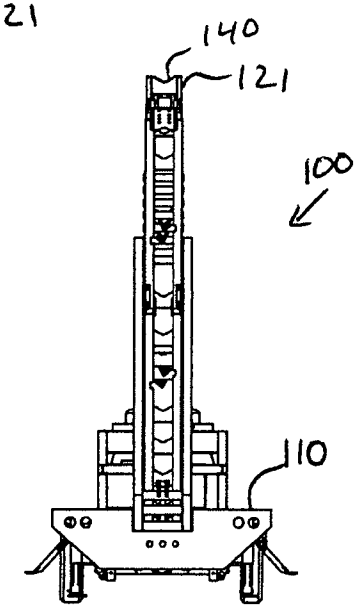
Figure 7A:
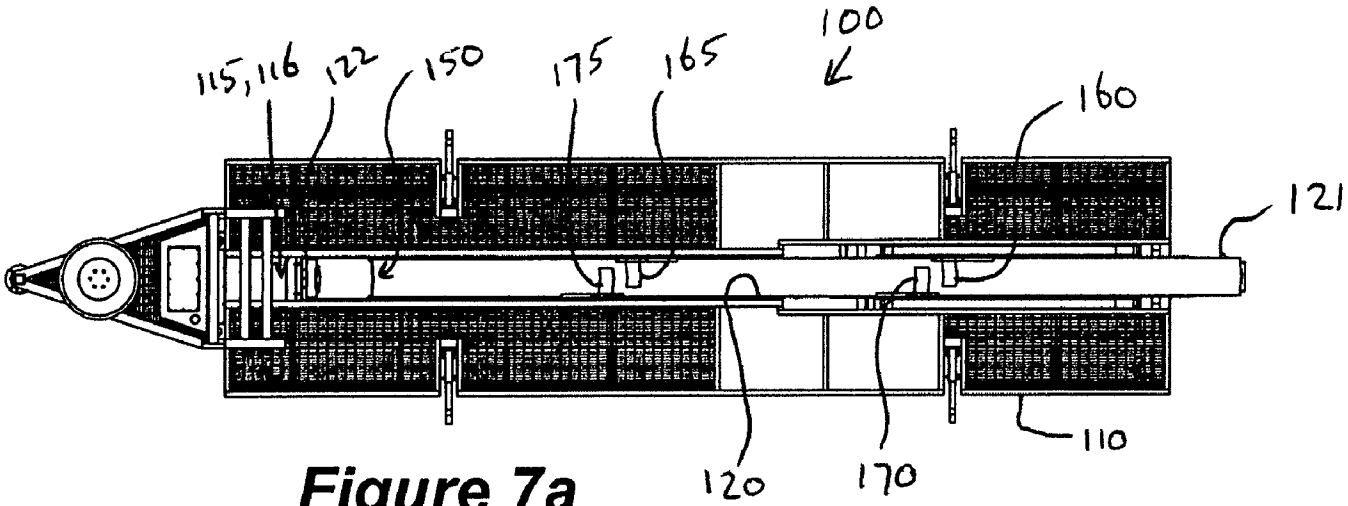
FIGS. 7*a*–7*c* are top, side and rear views according to FIG. 2, illustrating the boom's proximal end partially raised towards an intermediate height of the predetermined heights.
Figure 7C:
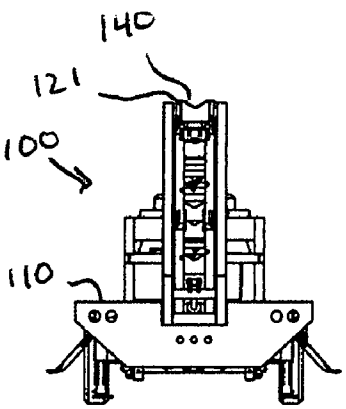
Figure 7B:
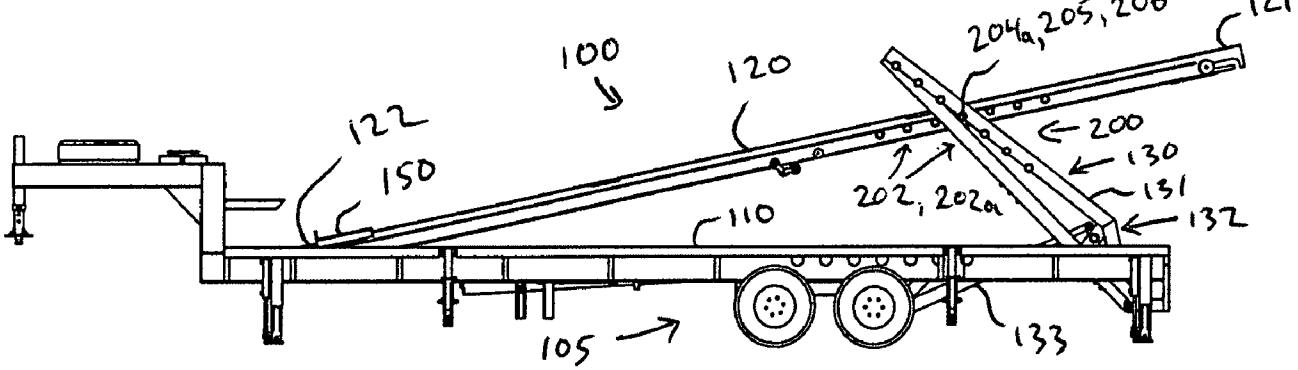
Figure 8A:
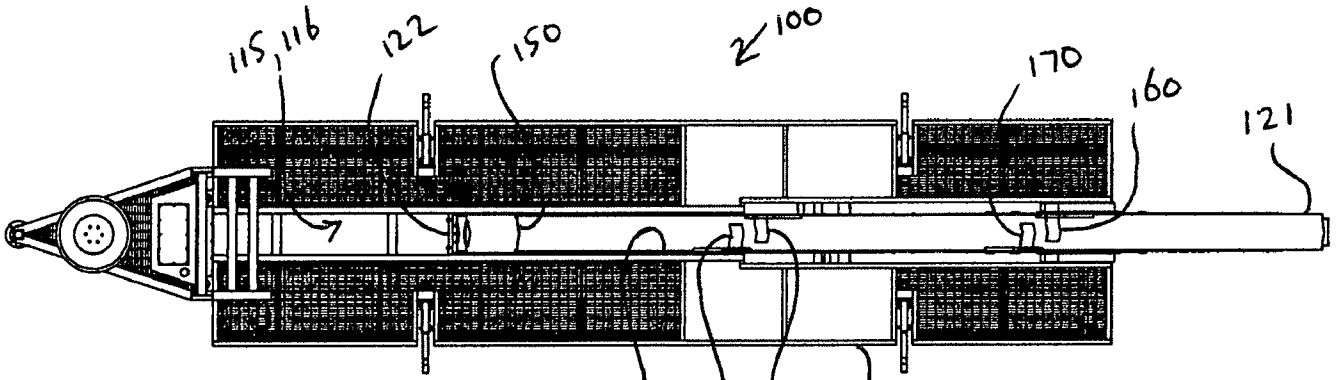
FIGS. 8*a*–8*c* are top, side and rear views according to FIGS. 7*a*–7*c* having the boom's proximal end raised to an intermediate height of the predetermined heights.
Figure 8B:
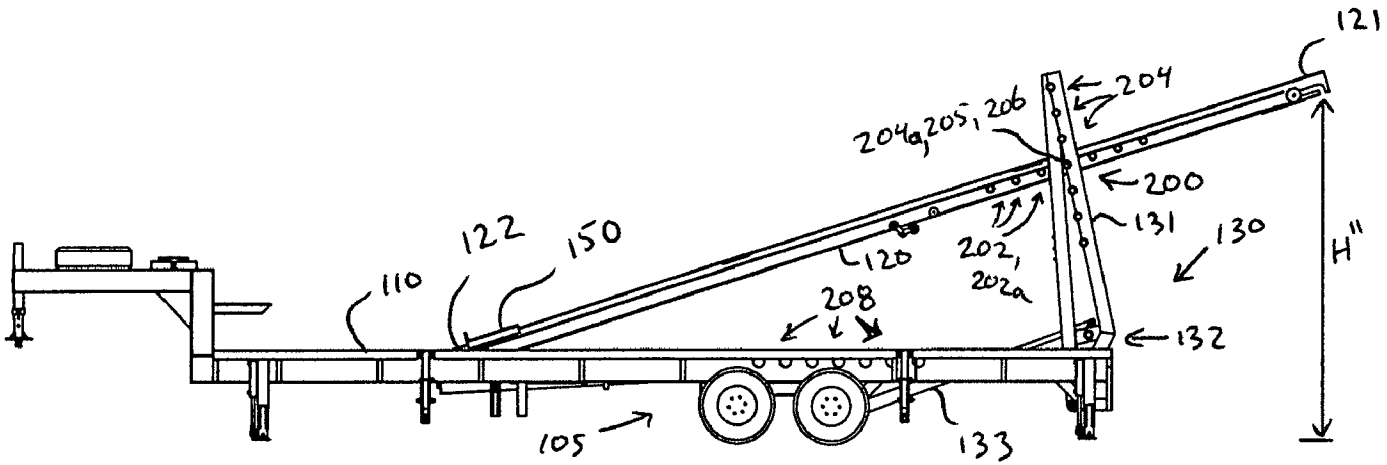
Figure 8C:
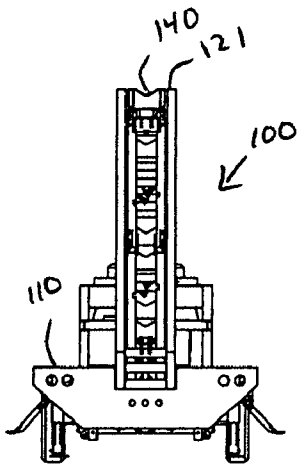
Figure 9C:
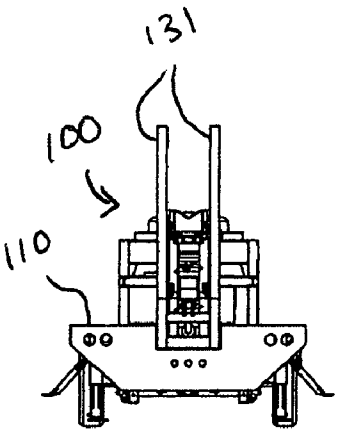
FIGS. 9*a*–9*c* are top, side and rear views according to FIG. 2 illustrating the boom's proximal end partially raised towards the lowest of the predetermined heights.
Figure 9A:
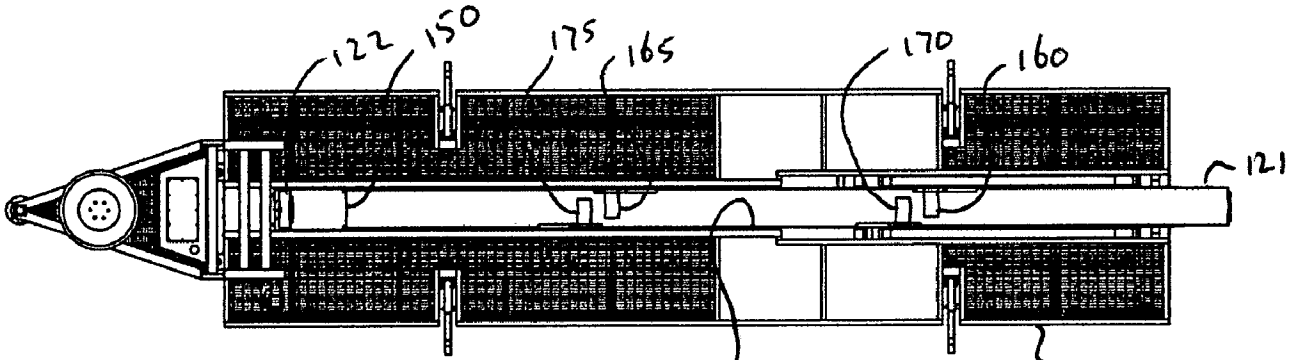
Figure 9B:
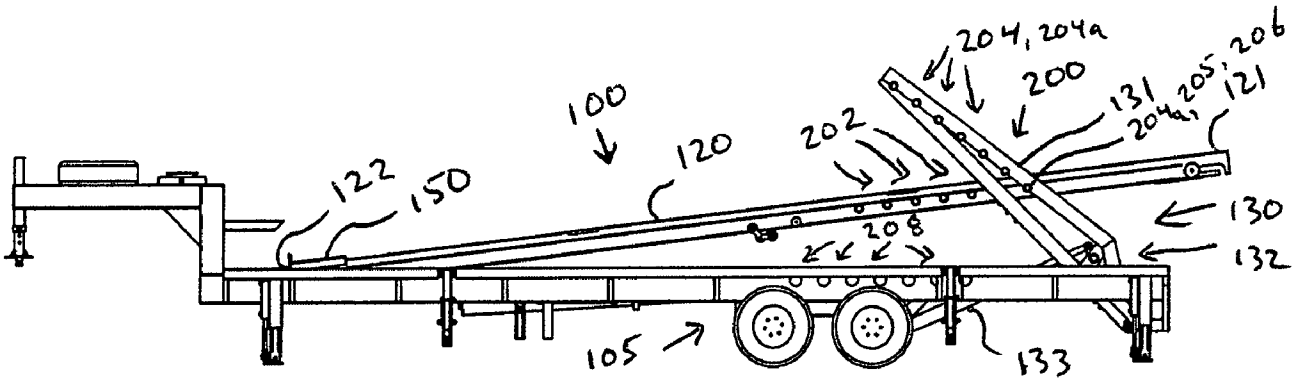
Figure 10A:
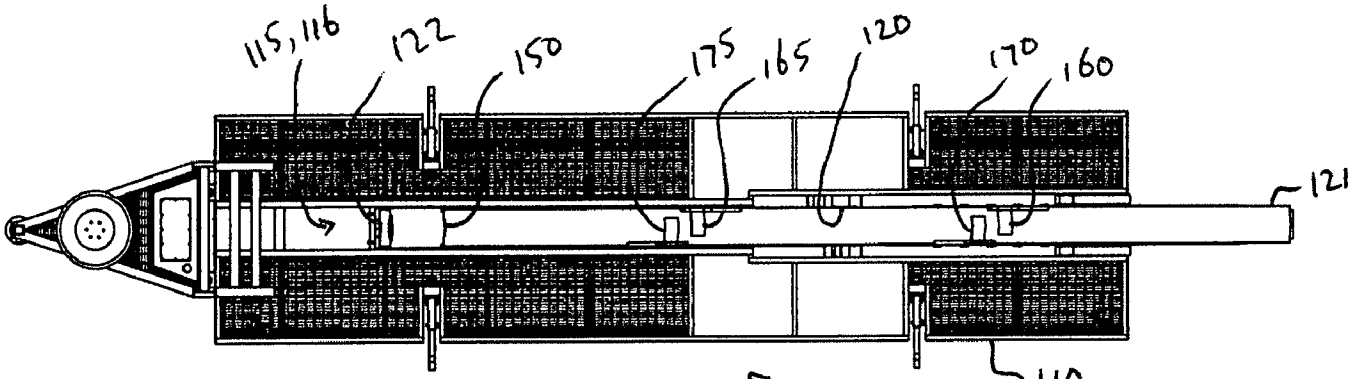
FIGS. 10*a*–10*c* are top, side and rear views according to FIGS. 9*a*–9*c* having the boom's proximal end raised to the lowest of the predetermined heights.
Figure 10B:
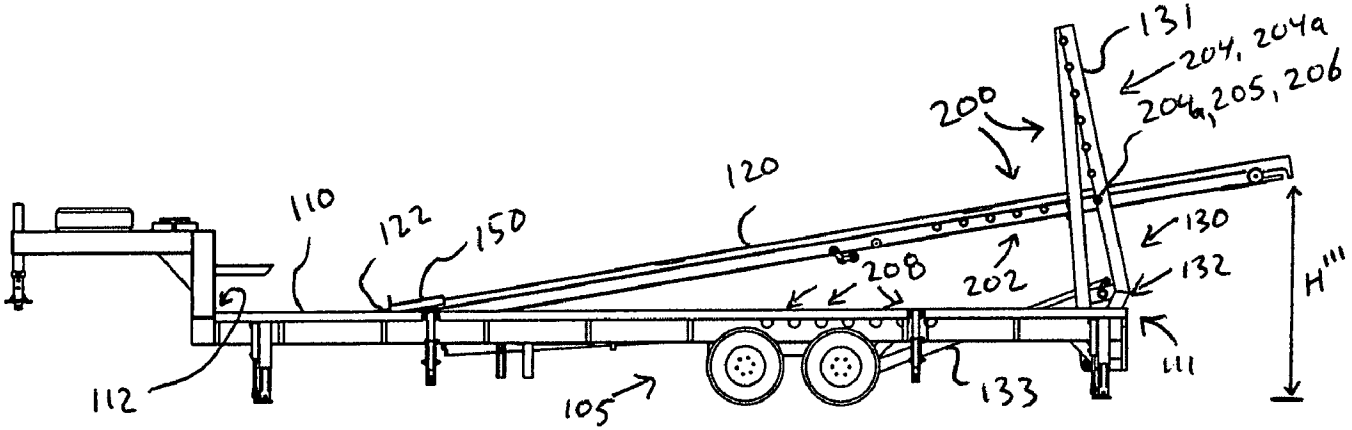
Figure 10C:
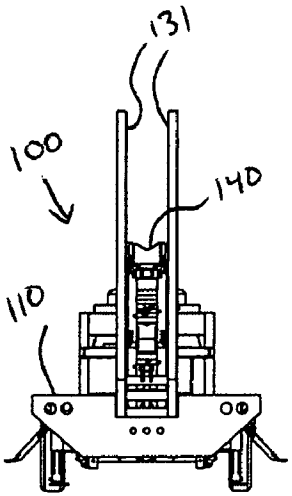

Best shown in FIGS. 4*c* and 5*b*, the boom 120 comprises a trough 140, for receiving pipe 148 therein, which extends longitudinally along boom 120 and may be formed therein or fastened thereon. Preferably trough 140 comprises carriage means 150 adapted to be driven bi-directionally between the boom's distal end 122 and proximal end 121, for the purpose of carrying a distal end of the pipe 148. More preferably, the trough 140 comprises ejector means 160, 165, 170, and 175 which are operable as the boom 120 lowers into the cavity 115 for the purpose of ejecting pipe 148 laterally from the trough 140.

Boom actuating means 130 comprises a pivoting member 131 pivotally connected between the base 110 at one of a plurality of hinge points. As shown, the pivoting member 131 can comprise two arms 131*a*, 131*b* which straddle or sandwich the boom 120 pivotally therebetween. A hydraulic ram 133 and suitable linkage 132 act between the base 110 and the pivoting member 131, for the purpose of positioning the boom's proximal end 121 for receiving pipe 148 into the trough 140 from the rig floor for further handling, typically returning same to the racks. To return from the rig floor to the base 110, actuating means 130 lowers boom 120 with pipe 148 therein such that, in its fully lowered or "laid down" position, boom 120 nests inside cavity 115 in base 110. Preferably, carriage means 150 carry the distal end of the pipe 148 from proximal end 121 of boom 120, at the level of the rig floor, to the distal end 122 of boom 120, at the level of the base 110. Although base 110 is shown in a mobile embodiment having any suitable undercarriage assembly 105, a person of skill in the art would understand that base 110 may also be of the stationary variety.

Referring now to FIGS. 2–11*b*, one embodiment of the multi-position height adjustment system 200 is illustrated. Preferably, operation of the pipe handling apparatus 100 is facilitated by repositioning the hinge point using a hinge pin 205 repositionable between the boom 120 and the pivoting member 131 so as to achieve variable height positioning of the proximal end 121 of the boom 120 while obtaining some consistency in the resting position or nesting of the distal end 122 in the cavity 115.

The height adjustment system 200 comprises two or more hinge pin holding means or boom ports 202 arranged in pre-determined spacing along the boom 120, and an equal number of hinge pin engagement means or arm ports 204 arranged along the pivoting member 131, preferably in the same pre-determined spacing as the boom ports 202. It is understood that in embodiments such as that shown herein having two arms 131*a*,131*b*, the term arm port 204 includes a pair of arm ports spaced either side of the boom, one per arm 131*a*,131*b*.

Each boom port 202 corresponds with an arm port 204 for forming a set of boom and arm ports 202,204 which can be aligned for receiving the hinge pin 205. The hinge pin 205 is suitable for removable coupling with the boom and arm ports 202.204 for pivotally coupling the boom 120 and pivoting member 131.

Figure 3:
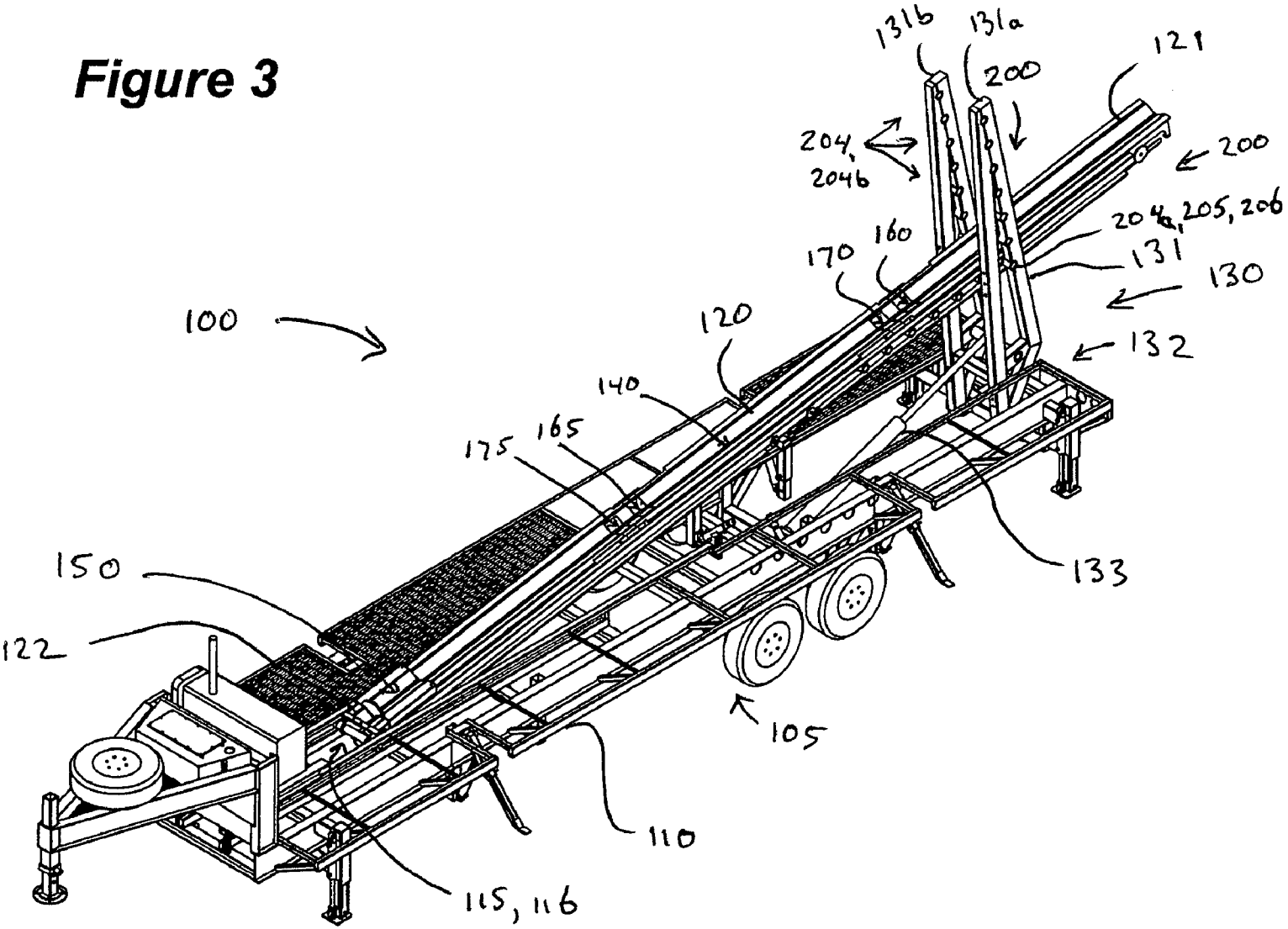
FIG. 3 is a perspective view according to FIG. 2, the boom illustrated having the proximal end raised to a lowest of the plurality of predetermined heights.

As shown, it is preferable to use an arrangement of linearly and equally boom ports 202 along the boom 120 and arm ports 204 along the pivoting member 131 so as to provide a linearly indexed variable adjustment to boom height. It is understood that other less regular spacing arrangements can be used to achieve greater of lesser adjustment at higher or lower elevations. Typically, the number of boom ports 202 correspond to the number of arm ports 204. The boom ports 202 are spaced from each other so as to correspond, or line-up, with the spacing of the arm ports 204 when the boom 120 is nestled inside the cavity 115. In other words, when the boom 120 and the distal end 122 are nestled in the cavity, hinge pin 205 can be alternatively engaged with any one of aligned and corresponding sets of boom and arm ports 202,204. For example, as shown in FIG. 2, hinge pin 205 is engaged in the third set of seven equally spaced corresponding boom and arm ports 202,204. As shown in FIG. 3, the pin 205 is engaged in the seventh set of seven corresponding boom and arm ports 202,204. When engaged, the hinge pins 205 do not protrude or otherwise interfere with the nestling of the boom 120 in the cavity 115.

Figure 12:
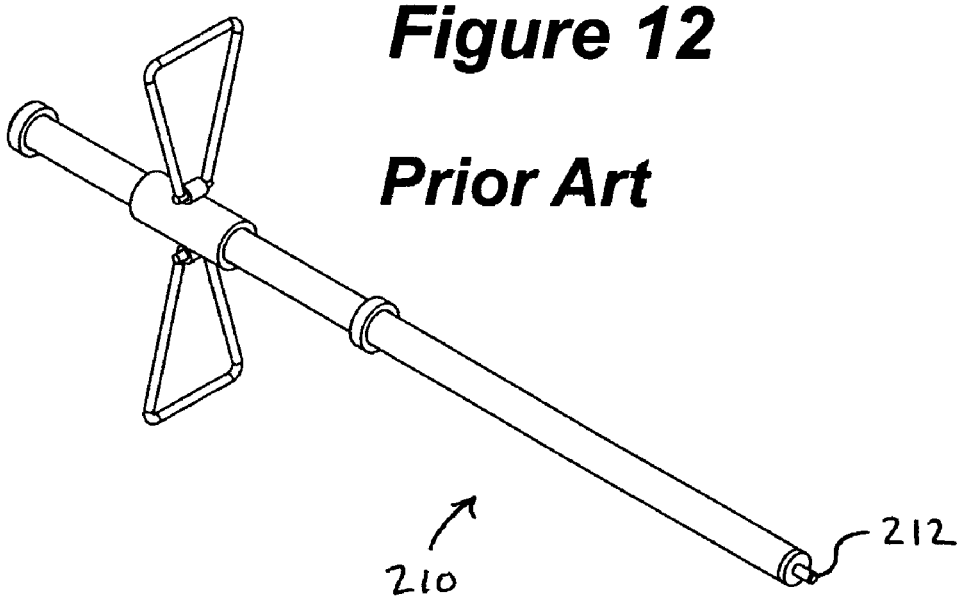
Figure 12 Prior Art
FIG. 12 is a perspective view of a prior-art slide-hammer suitable for use with the present invention.

Although hinge pin 205 is shown in a one-piece embodiment, a person of skill in the art would understand that pin 205 may also be an assembly such as a two-piece variety, with one piece removably placeable through one arm 131*a* of the pivoting member and the other piece removably placeable through the other arm 131*b*. Preferably, pin 205 comprises an internal threadable attachment 205*a* on either end adapted to threadably receive a threaded end 212 of a prior art slide-hammer 210 (as shown in FIG. 12) so as to facilitate quick removal of the pin 205 from the boom port 202 and arm port 204. More preferably, pin 205 further comprises internal grease conduits (not shown) and grease exits 205*b* in fluid communication with the internal attachment 205*a* so as to facilitate greasing of the pin 205 when placed inside the boom port 202.

In this embodiment seven boom ports 202 are spaced 12 inches centre-to-centre, and which extend through the boom 120 under the trough 140. Further seven arm ports 204*a*, 204*b* extend through the arms 131*a*, 131*b* of the pivoting member 131, and are spaced approximately 12 inches centre-to-centre from each other. This particular arrangement of the number of boom and arm ports 202, 204 and their spacing results in a range of operable boom heights H', H''' of approximately 20 feet 2 inches to 9 feet 1 inch from the ground respectively. These heights also depend on exactly how the undercarriage 105 is set up and whether it is supported off the ground by means of outriggers 106. A different number of boom ports 202 and corresponding number of arm ports 204, or a different linear spacing of the ports 202, 204, will work equally well.

Figure 13:
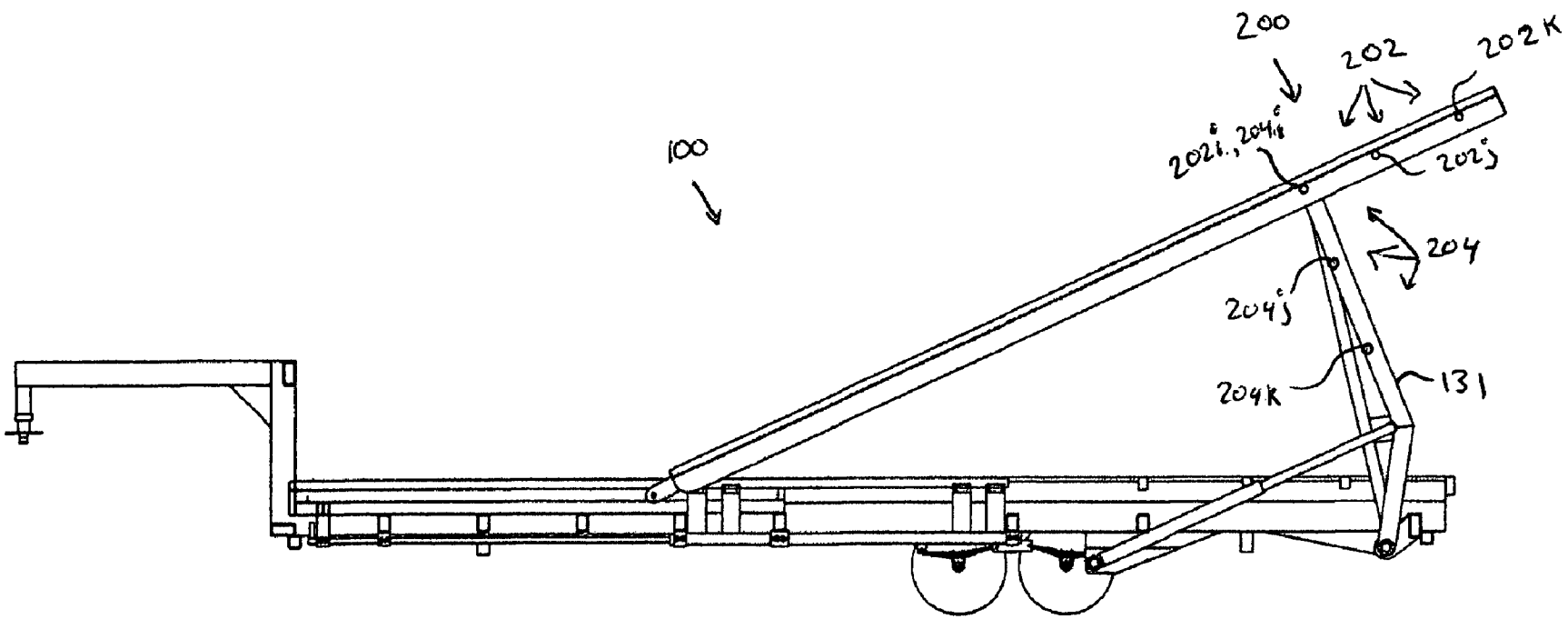
FIG. 13 is a side view of an alternate embodiment of the invention according to FIG. 2, wherein the boom's proximal end is operable to three predetermined heights.

In another embodiment of the height adjustment system 200 for a pipe handling apparatus 100, as illustrated in FIG. 13, there are three sets of boom and arm ports 202,204, wherein the distance between distal port set 202*i*, 204*i* and intermediate port set 202*j* 204*j* is 2 feet 2¼ inches and the distance between the intermediate ports 202*j*, 204*j* and proximal port set 202*k*, 204*k* is 2 feet 6¼ inches, resulting in a range of operable boom heights of 15 feet 8 inches to 8 feet 4 inches feet from the ground. Although boom and arm ports 202 and 204 are shown as a port embodiment, a person of skill in the art would understand that pin holding means 202 and pin engaging means 204 may be of different configurations such as hinge forming clamps or brackets spaced along different parts of the boom 120 or pivoting member 131.

As mentioned, the pipe handling apparatus 100 preferably comprises an equal number of boom and arm ports 202, 204 which align in sets relative to each other when the boom 120 is nestled inside the base 110. Such an arrangement allows the nestled boom 120 and distal end 122 to always be in the same place in the cavity 115 regardless which of the sets of corresponding boom and arm ports 202,204 the hinge pin 205 is engaged with. For example, placing the pin 205 through the most distal (the first of seven sets) of corresponding boom and arm ports 202,204 (FIG. 6*b*) or through the most proximal (the seventh of seven sets) of corresponding boom and arm ports 202, 204 (FIG. 10*b*) will, in either instance when the boom 120 is nestled inside the cavity 115, result in the distal end 122 of the boom 120 being positioned at a distal end 112 of the cavity 115 and the proximal end 121 of the boom 120 being positioned at a proximal end 111 of the cavity 115. This situation results even though the height attained by the proximal end 121 of the boom 120 in its fully raised position is substantially different (H' in FIG. 6*b* versus H''' in FIG. 10*b*). Accordingly, such an arrangement and operation of the pipe handling apparatus 100 facilitates operation of the ejector means 160, 165, 170,175 when the boom is so nestled.

Figure 11A:
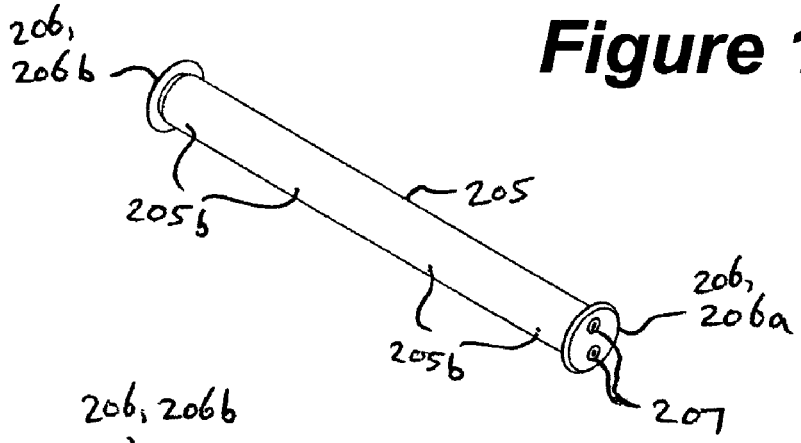
FIG. 11*a* is a perspective view of one embodiment of a pin and locking cap.
Figure 11B:
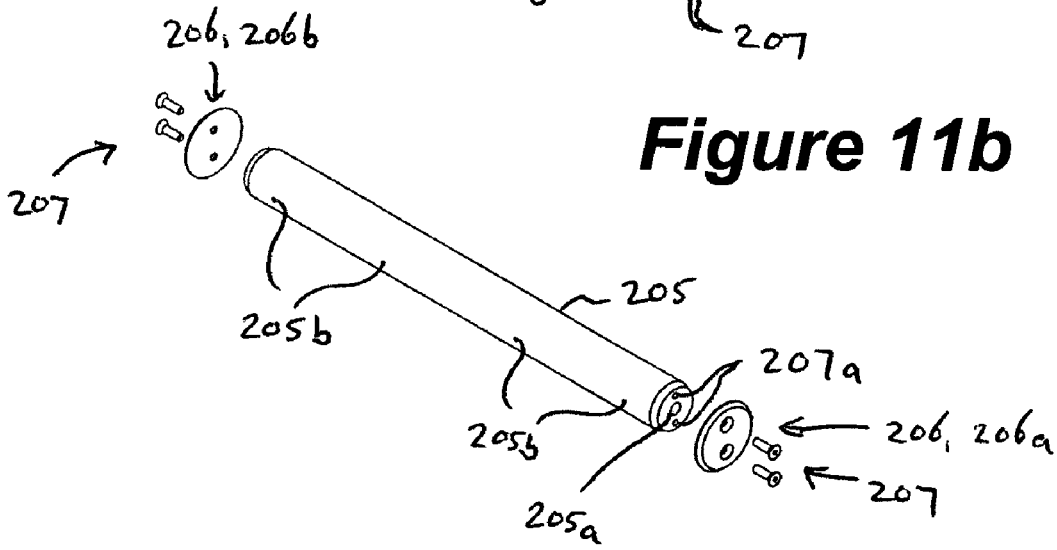
FIG. 11*b* is an exploded perspective view according to FIG. 11*a;*

With reference to FIGS. 11*a*, 11*b*, preferably the multi-position height adjustment system 200 further comprises pin securing means 206 to secure the pin 205 in place during operation. In this embodiment the pin securing means 206 comprises a pair of screw caps 206, larger in diameter than that of arm ports 204, which are retained on the ends of the pin 205 by a pair of screws 207. In operation, pin 205 extends through corresponding sockets of both boom and arm ports 202, 204 with the distal ends of the pin 205 lining up flush with outside faces of the arms 131*a*, 131*b*. Screw caps 206*a*, 206*b* are screwed onto each distal end of pin 205 by means of the screws 207 engaging screw holes 207*a* in the pin 205. As the screw caps 206 are larger in diameter than the arm ports 204 in the arms 131*a*, 131*b* the pair of caps 206 function to secure the pin within the boom and arm ports 202, 204. Although securing means 206 is shown in a screw cap embodiment, a person of skill in the art would understand that securing means 206 may be of different configurations such as snap rings retained within an inner groove inside arid near the outside edges of the sockets of the arms 131*a*, 131*b*, so as to retain or secure a pin 205 that would be slightly shorter than on that is flush with the outside edges of the arms 131*a*, 131*b*.

More preferably, the height adjustment system 200 further comprises a plurality of access ports 208 formed in the base 110 to facilitate easy removal of the pin 205. The access ports 208 are linearly spaced along the base 110 so as to correspond, or line-up, with the spacing of the boom and arm ports 202, 204 when the boom 120 is nestled inside the cavity 115. In this embodiment the access ports 208 are circular holes formed through the base 110 and, where screw caps 206 are employed, are of somewhat larger diameter than the caps 206 themselves. Advantageously for changing the height range of the boom's proximal end 121, pin 205 is removed from one set of boom and arm ports 202, 204, pulled through a corresponding port 208, and placed in another set of corresponding boom and arm ports 202, 204 through another corresponding access port 208, all while the boom 120 is in the nestled position.

Figure 14:
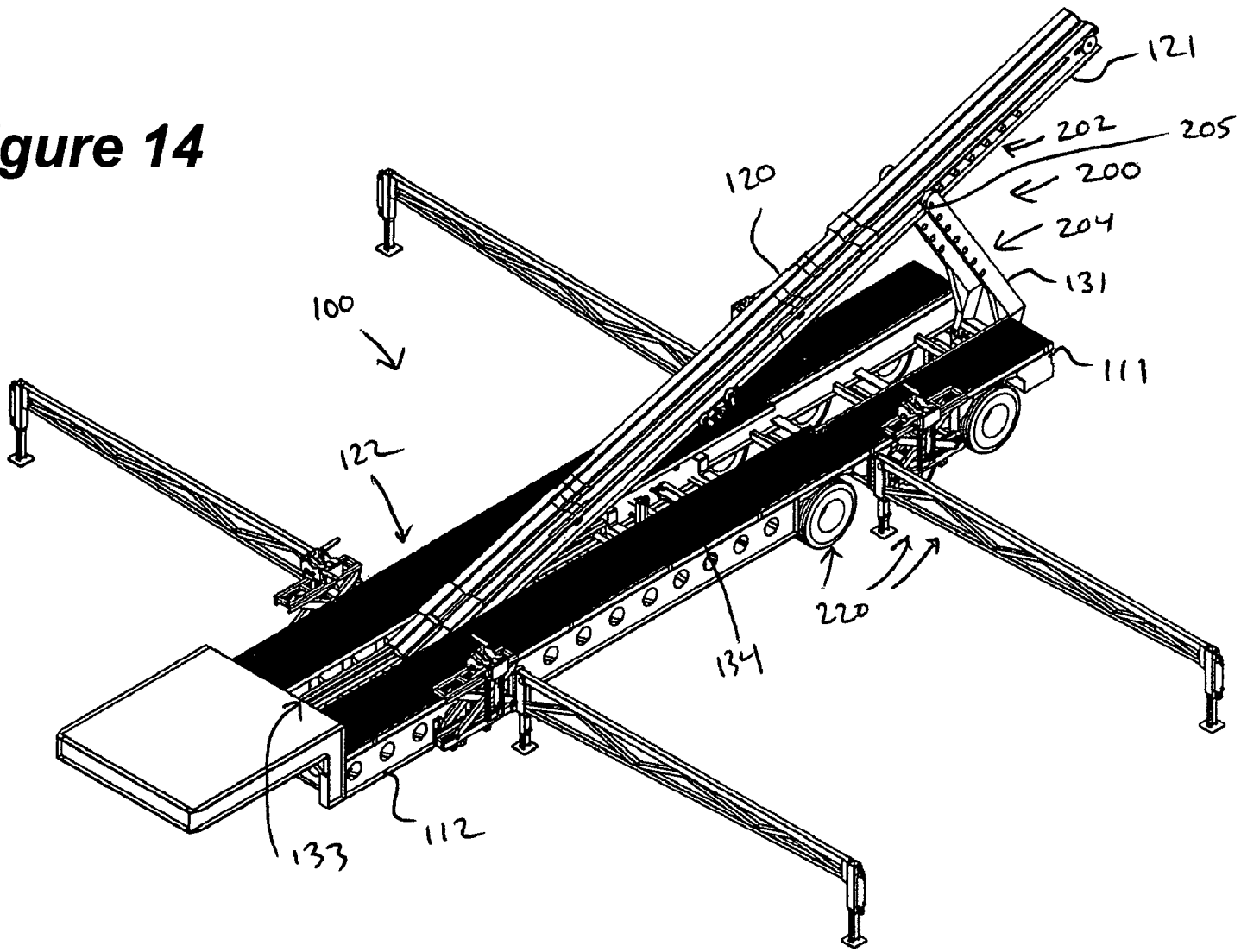
FIG. 14 is a perspective view of an alternate embodiment of the invention wherein an undercarriage assembly has three rear axles and wherein a hydraulic ram for actuating the boom is situated at the distal end of the base.
Figure 15A:
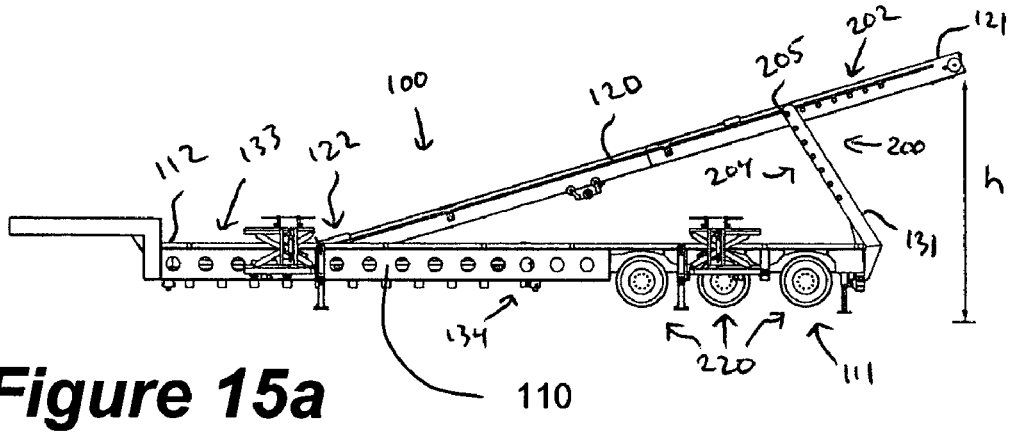
FIGS. 15*a*–15*c* are side views according to FIG. 14 illustrating the boom's proximal end raised to a highest (FIG. 15*a*), an intermediate (FIG. 15*b*), and a lowest (FIG. 15*c*) of the predetermined heights.
Figure 15B:
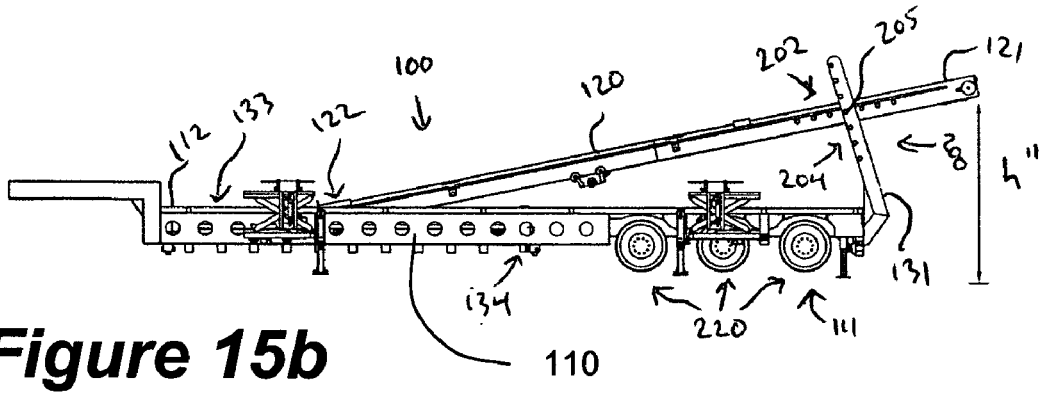
Figure 15C:
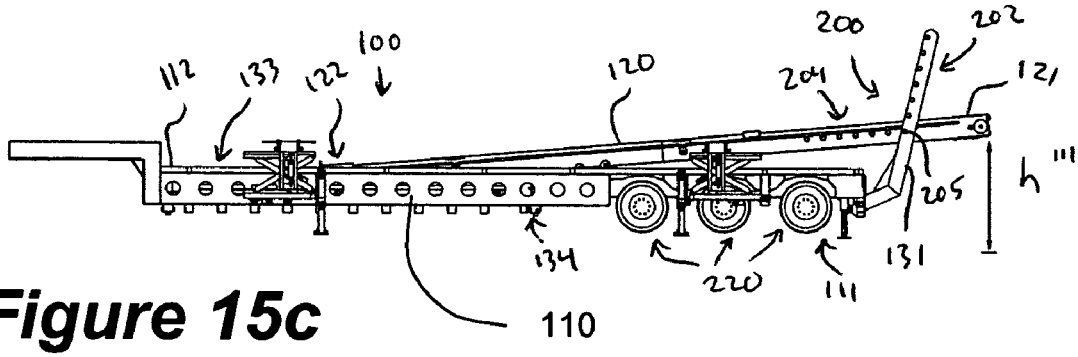

Referring to FIGS. 14–15*c*, another embodiment of the multi-position height adjustment system 200 for a pipe handling system 100 is adapted to an undercarriage assembly 105 having three rear axles 220. Unlike the embodiment of FIG. 2–10*c*, and as a result of the presence of the three rear axles 220 near the proximal end 111 of the base 110, the hydraulic ram 133 of the actuating means 130 is located at the distal end of the base 112 (obscured within the base 110) and drives the distal end 122 of the boom 120 rather than the pivoting member 131. Further, an additional and smaller hydraulic ram 134 is positioned intermediate the base 110 and is adapted to provide an initial upwards thrust to the boom 120. Furthermore, and again due to the location of the axles 220, there are no access ports in this embodiment. Removal and replacement of the pin 205, from one set of boom and arm ports 202, 204 to another may be accomplished by raising the boom 120 above the base 110 and then physically and supportably blocking both the boom 120 and pivoting member 131, such as by means of a section of pipe, while conducting the removal and replacement.

Figure 16:
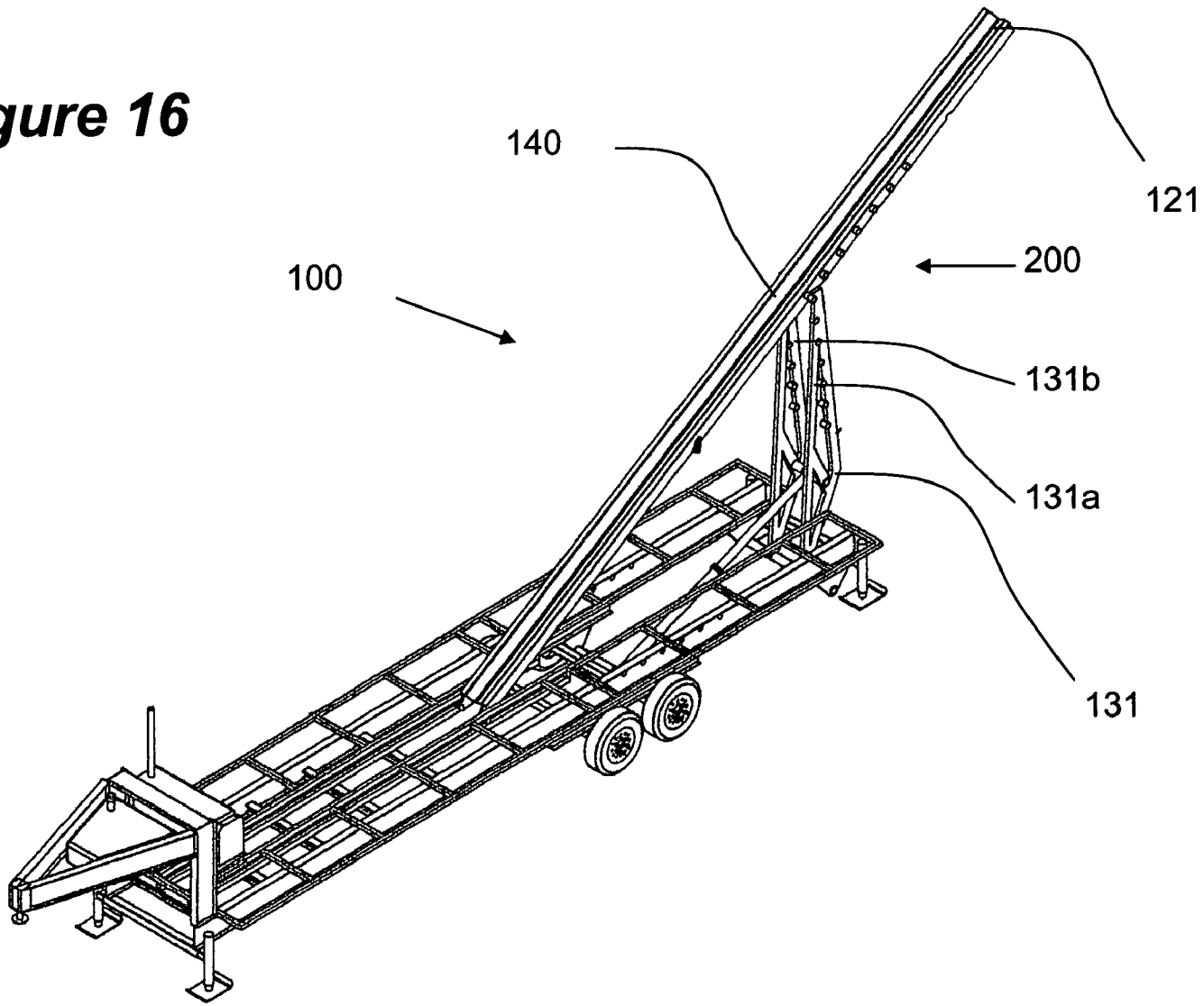
FIG. 16 is a perspective view of an alternate embodiment of the invention wherein, when the boom's proximal end is raised to the highest of the predetermined heights, arms of a pivoting member do not extend above a trough positioned along the boom.

Referring now to FIG. 16, another embodiment of the multi-position height adjustment system 200 for a pipe handling system 100 is shown wherein, when the boom's proximal end 121 is raised to the highest of the predetermined heights, the arms 131*a*,131*b* of the pivoting member 131 do not extend above the trough 140. However, as is the case in the embodiment of FIGS. 5*b*,6*b*, where tips of the arms 131*a*,131*b* extend up past the trough at the last pair of boom and arm ports 202,204, the arms 131*a*,131*b* themselves provide added safety by aiding in preventing pipe 148 from rolling out of the trough 140 during raising and lowering operations.

The embodiments of the invention in which an exclusive property or privilege is being claimed are defined as follows:

1. A pipe handling apparatus for presenting sections of pipe to one of a plurality of predetermined heights above the ground, comprising:

a longitudinally extending base having a proximal end and a distal end;

a longitudinally extending boom having a proximal end, a distal end and a trough extending along the boom and adapted for receiving at least one section of pipe therein, the distal end of the boom being movably guided in track means disposed at least partially along said longitudinally extending base;

a pivoting member pivotally connected between the base and said boom, the pivoting member being actuable for raising the proximal end of said boom to a raised position for the purpose of presenting at least one section of pipe to one of said plurality of predetermined heights as said distal end of said boom is moveably guided along said track means and for lowering the proximal end of said boom to a lowered position substantially parallel to the base; and two or more sets of hinge points between the pivoting member and the boom at predetermined spacings for achieving two or more predetermined heights of the proximal end of the boom when in the raised position.

2. The pipe handling apparatus of claim 1 wherein the hinge points further comprise:

boom ports arranged at the pre-determined spacing along the boom; and arm ports arranged at the pre-determined spacing along the pivoting member, and a hinge pin wherein when the boom is in a lowered position, each boom port aligns with an arm port to form a hinge point set so that the hinge pin can be engaged with any one of the two or more sets of hinge points.

3. The pipe handling apparatus of claim 2 wherein the pre-determined spacing is equal spacing.

4. The pipe handling apparatus of claim 2 wherein the pivoting member comprises two arms for sandwiching the boom therebetween at the hinge, wherein said arm ports comprise an arm port in each arm for aligning with the boom ports so as to be receiving and removeably engaging the hinge pin therein.

5. The pipe handling apparatus of claim 2 wherein the base further comprises a longitudinal cavity between said proximal and distal ends; and in the lowered position, the boom is nestled in the cavity.

6. The pipe handling apparatus of claim 5 wherein the pre-determined spacing is equal spacing.

7. The pipe handling apparatus of claim 5 further comprising two or more access ports arranged at the pre-determined spacing along the base for enabling removing and coupling of the hinge pin.

8. The pipe handling apparatus of claim 7 wherein the pre-determined spacing is equal spacing.

9. The pipe handling apparatus of claim 1 wherein the base further comprises a longitudinal cavity between said proximal and distal ends; and in the lowered position, the boom is nestled in the cavity.

10. A pipe handling apparatus for presenting sections of pipe to a plurality of predetermined heights above the ground, comprising:

a longitudinally extending base having a proximal end and a distal end, operable in a generally horizontal position, having a longitudinal cavity between said proximal and distal ends;

a longitudinally extending boom adapted for nestable positioning in said cavity, said boom further having a proximal end, a distal end, and a longitudinally extending trough for receiving at least one section of pipe therein, said distal end of the boom being moveably guided in track means disposed at least partially along said cavity;

a pivoting member coupled to said boom for raising the proximal end of said boom out of said cavity for the purpose of presenting at least one section of pipe to one of said plurality of predetermined heights; and multi-position height adjustment means for setting a plurality of predetermined heights of the proximal end of the boom.

11. The pipe handling apparatus of claim 10 wherein the hinge pin further comprises an internal threadable attachment on either end adapted to threadably receive a threaded end of a slide-hammer.

12. The pipe handling apparatus of claim 10 further comprising pin securing means.

13. The pipe handling apparatus of claim 12 wherein the pin securing means comprise a pair of screw caps screwably retainable on the ends of the hinge pin.

14. The pipe handling apparatus of claim 10 further comprising access ports linearly spaced along the base so as to correspond with the linear spacing of the pin engagement means when the boom is nestled inside the cavity.

15. A system for adjusting the height of a longitudinally extending boom on a pipe handling apparatus, said pipe handling apparatus having a longitudinally extending base having a proximal end and a distal end, a longitudinal cavity between said proximal and distal ends, said boom adapted for nestable positioning in said cavity, and a pivoting member coupled to said boom for raising a proximal end of said boom out of said cavity to one of a plurality of predetermined heights as a distal end of said boom is moveably guided along track means disposed at least partially along said cavity, the system comprising:

a plurality of pin holding means linearly arranged along the boom;

an equal number of pin engagement means linearly arranged along the pivoting member wherein each of said pin engagement means corresponds to and aligns with one of said plurality of pin holding means when the boom is nestled inside the cavity; and a hinge pin suitable for removable placement inside any one of said plurality of pin holding means and its corresponding pin engagement means when the boom is nestled inside the cavity, the selection thereof determines the predetermined height that the proximal end of said boom can be raised to.

16. The system of claim 15 wherein the hinge pin further comprises an internal threadable attachment on either end adapted to threadably receive a threaded end of a slide-hammer.

17. The system of claim 15 further comprising pin securing means.

18. The system of claim 17 wherein the pin securing means comprise a pair of screw caps screwably retainable on the ends of the hinge pin.

19. The system of claim 15 further comprising access ports linearly spaced along the base so as to correspond with the linear spacing of the pin engagement means when the boom is nestled inside the cavity.

* * * * *